US012668862B2

(12) United States Patent
Seto et al.

(10) Patent No.: US 12,668,862 B2
(45) Date of Patent: Jun. 30, 2026

(54) AUSTENITIC STAINLESS STEEL AND TUBE

(71) Applicant: NIPPON STEEL CORPORATION, Tokyo (JP)

(72) Inventors: Masahiro Seto, Tokyo (JP); Takumi Nishimoto, Tokyo (JP); Katsuki Tanaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 407 days.

(21) Appl. No.: 18/564,389

(22) PCT Filed: May 26, 2022

(86) PCT No.: PCT/JP2022/021607
§ 371 (c)(1),
(2) Date: Nov. 27, 2023

(87) PCT Pub. No.: WO2022/255223
PCT Pub. Date: Dec. 8, 2022

(65) Prior Publication Data

US 2024/0254609 A1 Aug. 1, 2024

(30) Foreign Application Priority Data

May 31, 2021 (JP) ..... 2021-091783

(51) Int. Cl.
*C22C 38/58* (2006.01)
*C21D 1/18* (2006.01)
(Continued)

(52) U.S. Cl.
CPC ..... *C22C 38/58* (2013.01); *C21D 1/18* (2013.01); *C21D 1/32* (2013.01); *C21D 6/004* (2013.01);
(Continued)

(58) Field of Classification Search
CPC ..... C22C 38/001; C22C 38/02; C22C 38/04; C22C 38/42; C22C 38/44; C22C 38/46;
(Continued)

(56) References Cited

U.S. PATENT DOCUMENTS

2003/0231976 A1* 12/2003 Iseda ..... C22C 38/50 148/592
2016/0304983 A1* 10/2016 Omura ..... C22C 38/004
2021/0108297 A1* 4/2021 Tsuge ..... C21D 9/46

FOREIGN PATENT DOCUMENTS

EP 3 508 602 A1 7/2019
JP 2003-268503 A 9/2003
JP 2021-21093 A 2/2021

* cited by examiner

*Primary Examiner* — Nicholas A Wang
(74) *Attorney, Agent, or Firm* — Birch, Stewart, Kolasch & Birch, LLP

(57) ABSTRACT

There is provided an austenitic stainless steel having a chemical composition that comprises, in mass %: C: 0.002 to 0.020%, Si: 0.10 to 0.60%, Mn: 0.2 to 2.0%, P: 0.035% or less, S: 0.010% or less, Cu: 2.50 to 4.50%, Ni: 9.00 to 16.00%, Cr: 15.00 to 20.00%, Mo: 0.20 to 1.50%, Nb: 0.15 to 0.60%, N: 0.05 to 0.15%, B: 0.0010 to 0.0060%, and optional elements, with the balance: Fe and impurities and that satisfies $[0.010 \leq V_{ER}+Ti_{ER}+Nb_{ER}]$, $[27.0 \leq 1.13(Ni—Ni_{ER})+(Cr—Cr_{ER})+1.85(Mo—Mo_{ER})+1.79(Nb—Nb_{ER}) < 40.5]$, and $[Nb_{ER} < 0.052]$.

8 Claims, 1 Drawing Sheet

(51) Int. Cl.

| | |
|---|---|
| ***C21D 1/32*** | (2006.01) |
| ***C21D 6/00*** | (2006.01) |
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C21D 6/005* (2013.01); *C21D 6/007* (2013.01); *C21D 6/008* (2013.01); *C21D 8/10* (2013.01); *C21D 9/08* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01)

(58) Field of Classification Search

CPC ..... C22C 38/54; C22C 38/48; C22C 38/50; C22C 38/52; C22C 38/58; C22C 38/002; C22C 38/005; C22C 38/004; C22C 38/008; C22C 38/06; C22C 38/00; C21D 6/004; C21D 9/46; C21D 2211/001; C21D 1/60; C21D 8/10; C21D 9/08; C21D 2211/004; C21D 1/18; C21D 1/26; C21D 1/32; C21D 6/005; C21D 6/007; C21D 6/008; C21D 6/02; C21D 7/06; C21D 9/085; C21D 8/0236; C21D 8/0263; C21D 2211/005; C21D 8/0226; C21D 8/0273; C21D 9/525

See application file for complete search history.

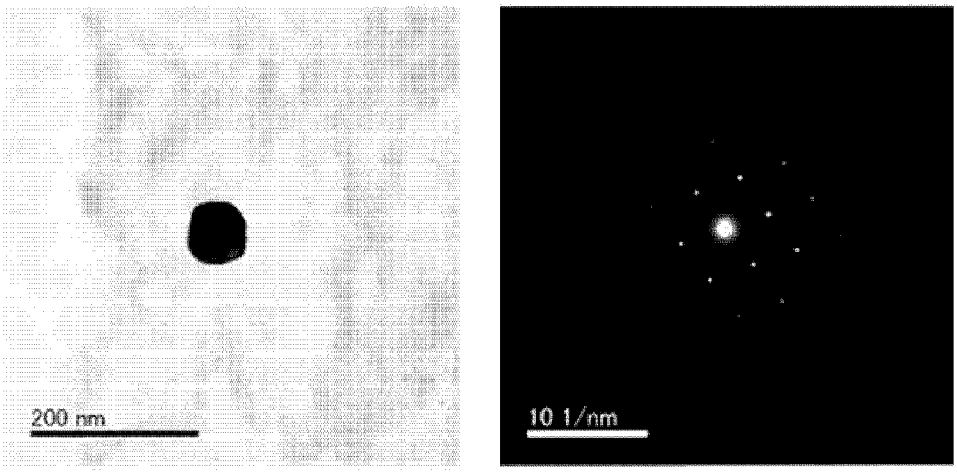
200 nm
10 1/nm
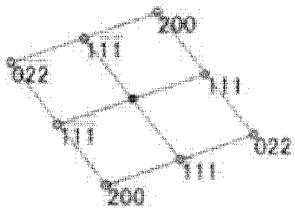
200
111
022
111
111
022
111
200

AUSTENITIC STAINLESS STEEL AND TUBE

TECHNICAL FIELD

The present disclosure relates to an austenitic stainless steel and a tube.

BACKGROUND ART

A boiler installed in a plant such as a thermal power plant and a chemical plant is exposed to high temperature. For this reason, a heat-transfer tube that is used in a boiler (hereinafter, will be expressed as a "heat-transfer tube for a boiler") is required to have a favorable high temperature strength, specifically, a s favorable creep strength.

For a heat-transfer tube for a boiler, an austenitic stainless steel is used in some cases from the viewpoint of corrosion resistance. For example, Patent Documents 1 and 2 each disclose an austenitic stainless steel having a favorable creep strength.

LIST OF PRIOR ART DOCUMENTS

Patent Document

Patent Document 1: JP2003-268503A
Patent Document 2: JP2021-21093A

SUMMARY OF INVENTION

Technical Problem

In addition, an environment where a heat-transfer tube for a boiler is used in a plant has recently become harsher, and stress-corrosion cracking (hereinafter, will be expressed as "SCC") may occur. In addition to a favorable creep strength, a starting material of a heat-transfer tube for a boiler is thus required to be able to prevent the SCC. However, Patent Documents 1 and 2 have no studies about the SCC. Therefore, there is still room for improvement in SCC resistance of the austenitic stainless steels disclosed in the documents.

In view of the above, an objective of the present disclosure is to solve the problems and provide an austenitic stainless steel having a favorable creep strength and a favorable SCC resistance.

Solution to Problem

The present disclosure is made to solve the problems described above, and the gist of the present invention is the following austenitic stainless steel and tube.

(1) An austenitic stainless steel having a chemical composition including, in mass %:

C: 0.002 to 0.020%,
Si: 0.10 to 0.60%,
Mn: 0.2 to 2.0%,
P: 0.035% or less,
S: 0.010% or less,
Cu: 2.50 to 4.50%,
Ni: 9.00 to 16.00%,
Cr: 15.00 to 20.00%,
Mo: 0.20 to 1.50%,
Nb: 0.15 to 0.60%,
N: 0.05 to 0.15%,
B: 0.0010 to 0.0060%,
V: 0 to 0.50%,
Ti: 0 to 0.500%, Co: 0 to 1.00%,
W: 0 to 1.00%,
Ta: 0 to 0.40%,
Sn: 0 to 0.0300%,
Ca: 0 to 0.0100%,
Mg: 0 to 0.0100%, and
REM: 0 to 0.0800%,
with the balance: Fe and impurities, and
satisfies Formulas (i) to (iii) shown below:

$$0.010 \leq V_{ER} + Ti_{ER} + Nb_{ER} \quad \text{(i)}$$

$$27.0 \leq 1.13(Ni—Ni_{ER}) + (Cr—Cr_{ER}) + 1.85(Mo—Mo_{ER}) + 1.79(Nb—Nb_{ER}) < 40.5 \quad \text{(ii)}$$

$$Nb_{ER} < 0.052 \quad \text{(iii)}$$

where symbols in the formulas are defined as follows, symbols of elements in the formulas indicate contents (mass %) of the elements contained in the steel, and zero is assigned to a symbol of an element when the element is not contained:

$V_{ER}$: Content of V in precipitates obtained by extraction residue analysis (mass %)
$Ti_{ER}$: Content of Ti in precipitates obtained by extraction residue analysis (mass %)
$Nb_{ER}$: Content of Nb in precipitates obtained by extraction residue analysis (mass %)
$Ni_{ER}$: Content of Ni in precipitates obtained by extraction residue analysis (mass %)
$Cr_{ER}$: Content of Cr in precipitates obtained by extraction residue analysis (mass %)
$Mo_{ER}$: Content of Mo in precipitates obtained by extraction residue analysis (mass %).

(2) The austenitic stainless steel according to (1) above, wherein the chemical composition contains, in mass %, one or more elements selected from:

V: 0.01 to 0.50%, and
Ti: 0.001 to 0.500%.

(3) The austenitic stainless steel according to (1) or (2) above, wherein the chemical composition contains, in mass %, one or more elements selected from:

Co: 0.02 to 1.00%,
W: 0.01 to 1.00%,
Ta: 0.01 to 0.40%,
Sn: 0.0010 to 0.0300%,
Ca: 0.0010 to 0.0100%,
Mg: 0.0002 to 0.0100%, and
REM: 0.0010 to 0.0800%.

(4) A tube including the austenitic stainless steel according to any one of (1) to (3) above.

Advantageous Effects of Invention

According to the present disclosure, an austenitic stainless steel having a favorable creep strength and a favorable SCC resistance can be provided.

BRIEF DESCRIPTION OF DRAWING

FIG. 1 is a micro-structure photograph obtained by observation of a compound of Nb.

DESCRIPTION OF EMBODIMENTS

The present inventors conducted studies about a method for improving a creep strength and an SCC resistance of an austenitic stainless steel and obtained the following findings (a) to (c).

(a) C (carbon) has an effect of increasing the creep strength. For this reason, the austenitic stainless steel disclosed in Patent Document 1 contains 0.03% or more of C. However, in an austenitic stainless steel, C may cause SCC to occur. For example, when an austenitic stainless steel is heated to about 600 to 700° C., Cr (chromium) in the steel combines with C in the steel to form Cr carbides. As a result, Cr depleted zone is produced, which causes the SCC to occur in a corrosive environment in which chlorides and the like are present. It is therefore necessary to reduce the content of C from the viewpoint of preventing the SCC.

(b) To prevent the SCC, in addition to simply reducing the content of C, controlling an amount of C that is dissolved in parent phases (hereinafter, will be expressed as "dissolved C") within an appropriate range is effective. When the dissolved C is heated in a use environment or the like, the dissolved C comes out of its dissolved state, combining with Cr to form Cr carbides. The Cr carbides degrade the SCC resistance. It is therefore desirable to reduce the dissolved C in the pre-use stage of the austenitic stainless steel by causing C to combine with elements such as V (vanadium), Ti (titanium), and Nb (niobium) to precipitate C in advance.

(c) At the same time, the reducing of the content of C makes it difficult to ensure the creep strength. Thus, with the intention of enhancing the creep strength, it is effective to make the austenitic stainless steel contain elements such as Ni (nickel), Cr, Mo (molybdenum), and Nb. These elements enhance the creep strength by forming their precipitates in a use environment that causes exposure to high temperature. However, in the case where the elements form their precipitates before use of the austenitic stainless steel at high temperature, the creep strength cannot be enhanced sufficiently. To provide a favorable creep strength, it is therefore desirable that, in the pre-use stage of the austenitic stainless steel, these elements be dissolved in matrix as much as possible, and these elements form their precipitates in the use environment. Accordingly, it is necessary to adjust solubilities of the elements to within their appropriate ranges in advance in the pre-use stage of the austenitic stainless steel.

In view of the above, it is desirable to adjust the balance between dissolution and precipitation of elements in the steel by appropriately controlling a chemical composition and producing conditions.

The present disclosure has been made based on the above findings. Requirements of the present embodiment will be described below in detail.

1. Chemical Composition

Reasons for limiting the contents of elements are as follows. In the following description, the symbol "%" for contents means "mass %."

C: 0.002 to 0.020%

C (carbon) is an element necessary to provide high temperature strength, particularly creep strength. For this reason, the content of C is set to 0.002% or more. The content of C is preferably set to 0.003% or more, more preferably set to 0.004% or more. However, if C is contained excessively, the SCC resistance is degraded. For this reason, the content of C is set to 0.020% or less. The content of C is preferably set to 0.015% or less, more preferably set to 0.010% or less.

Si: 0.10 to 0.60%

Si (silicon) is an element having a deoxidation effect. For this reason, the content of Si is set to 0.10% or more. The content of Si is preferably set to 0.12% or more, and the content of Si is more preferably set to 0.14% or more. However, if Si is contained excessively, workability is degraded. For this reason, the content of Si is set to 0.60% or less. The content of Si is preferably set to 0.50% or less, more preferably set to 0.40% or less.

Mn: 0.2 to 2.0%

Mn (manganese) has an effect of enhancing hot workability by combining with S that is an impurity contained in steel, forming MnS. For this reason, the content of Mn is set to 0.2% or more. The content of Mn is preferably set to 0.4% or more, more preferably set to 0.6% or more. However, if Mn is contained excessively, the resultant steel becomes brittle, and thus workability and weldability are rather degraded. For this reason, the content of Mn is set to 2.0% or less. The content of Mn is preferably set to 1.5% or less, more preferably set to 1.3% or less.

P: 0.035% or Less

P (phosphorus) is an element that is contained in steel as an impurity. P degrades the SCC resistance. P also degrades a hot workability and a toughness of steel. For this reason, the content of P is set to 0.035% or less. The content of P is preferably set to 0.030% or less, more preferably set to 0.025% or less. The content of P is preferably reduced as much as possible, but an excessive reduction of the content of P increases producing costs. For this reason, the content of P is preferably set to 0.010% or more.

S: 0.010% or Less

S (sulfur) is an element that is contained in steel as an impurity. S degrades the SCC resistance. S also degrades a hot workability and a creep ductility of steel. For this reason, the content of S is set to 0.010% or less. The content of S is preferably set to 0.009% or less, more preferably set to 0.008% or less. The content of S is preferably reduced as much as possible, but an excessive reduction of the content of S increases producing costs. For this reason, the content of S is preferably set to 0.0001% or more.

Cu: 2.50 to 4.50%

Cu (copper) precipitates in grains in the forms of Cu phases, increasing a creep strength and a creep ductility of steel through precipitation strengthening. For this reason, the content of Cu is set to 2.50% or more. The content of Cu is preferably set to 2.70% or more, more preferably set to 2.90% or more. However, if Cu is contained excessively, hot workability and weldability are degraded. For this reason, the content of Cu is set to 4.50% or less. The content of Cu is preferably set to 4.00% or less, more preferably set to 3.50% or less.

Ni: 9.00 to 16.00%

Ni (nickel) is an element that stabilizes an austenitic structure. Ni has an effect of enhancing the SCC resistance and corrosion resistance. Ni also has an effect of enhancing the creep strength. For this reason, the content of Ni is set to 9.00% or more. The content of Ni is preferably set to 10.00% or more, more preferably set to 10.50% or more. However, if Ni is contained excessively, producing costs are increased. In addition, the creep strength is rather decreased. For this reason, the content of Ni is set to 16.00% or less. The content of Ni is preferably set to 15.00% or less, more preferably set to 14.00% or less.

Cr: 15.00 to 20.00%

Cr (chromium) is an element that is necessary to provide corrosion resistance. Cr also has an effect of enhancing the creep strength. For this reason, the content of Cr is set to 15.00% or more. The content of Cr is preferably set to 15.50% or more, more preferably set to 16.00% or more. However, if Cr is contained excessively, a stability of the resultant austenitic structure is degraded, and weldability is also degraded. For this reason, the content of Cr is set to 20.00% or less. The content of Cr is preferably set to 19.75% or less, more preferably set to 19.50% or less.

Mo: 0.20 to 1.50%

Mo (molybdenum) has an effect of enhancing the creep strength. For this reason, the content of Mo is set to 0.20% or more. The content of Mo is preferably set to 0.35% or more, more preferably set to 0.50% or more. However, if Mo is contained excessively, a stability of the resultant austenitic structure is degraded. Therefore, the content of Mo is set to 1.50% or less. The content of Mo is preferably set to 1.25% or less, more preferably set to 1.00% or less.

Nb: 0.15 to 0.60%

Nb (niobium) has an effect of enhancing the creep strength and the SCC resistance. For this reason, the content of Nb is set to 0.15% or more. The content of Nb is preferably set to 0.20% or more, more preferably set to 0.25% or more. However, if Nb is contained excessively, significantly coarse precipitates are produced, rather decreasing the creep strength. For this reason, the content of Nb is set to 0.60% or less. The content of Nb is preferably set to 0.55% or less, more preferably set to 0.50% or less.

N: 0.05 to 0.15%

N (nitrogen) has an effect of enhancing strength through solid-solution strengthening and precipitation strengthening that is brought by Nb carbo-nitrides. For this reason, the content of N is set to 0.05% or more. The content of N is preferably set to 0.06% or more, more preferably set to 0.07% or more. However, if N is contained excessively, lump-like nitrides are produced, degrading steel quality. As a result, strength may be decreased. For this reason, the content of N is set to 0.15% or less. The content of N is preferably set to 0.13% or less, more preferably set to 0.12% or less.

B: 0.0010 to 0.0060%

B (boron) has an effect of increasing creep ductility. For this reason, the content of B is set to 0.0010% or more. The content of B is preferably set to 0.0015% or more, more preferably set to 0.0020% or more. However, if B is contained excessively, weldability and hot workability at high temperature are degraded. For this reason, the content of B is set to 0.0060% or less. The content of B is preferably set to 0.0050% or less, more preferably set to 0.0045% or less.

In addition to the elements described above, one or more elements selected from V and Ti may be contained within the ranges described below in the chemical composition of the austenitic stainless steel in the present embodiment. Reasons for limiting the contents of the elements will be described.

V: 0 to 0.50%

V (vanadium) has an effect of increasing the SCC resistance by reducing the dissolved C. V also has an effect of increasing the creep strength. For this reason, V may be contained as necessary. However, if V is contained excessively, δ ferrite is produced, which degrades a creep strength, a toughness, and a weldability of the resultant steel. For this reason, the content of V is set to 0.50% or less. The content of V is preferably set to 0.40% or less, more preferably set to 0.30% or less. On the other hand, to provide the effects, the content of V is preferably set to 0.01% or more, more preferably set to 0.02% or more.

Ti: 0 to 0.500%

As with V, Ti (titanium) has an effect of increasing the SCC resistance by reducing the dissolved C. Ti also has an effect of increasing the creep strength. For this reason, Ti may be contained as necessary. However, if Ti is contained excessively, the creep strength is rather decreased. For this reason, the content of Ti is set to 0.500% or less. The content of Ti is preferably set to 0.400% or less, more preferably set to 0.100% or less, further preferably set to 0.050% or less. On the other hand, to provide the effects, the content of Ti is preferably set to 0.001% or more, more preferably set to 0.002% or more.

In addition to the elements described above, one or more elements selected from Co, W, Ta, Sn, Ca, Mg, and REM may be contained within their respective ranges described below in the chemical composition of the steel in the present embodiment. Reasons for limiting the contents of the elements will be described.

Co: 0 to 1.00%

Co (cobalt) has an effect of stabilizing an austenitic structure and increasing the creep strength. For this reason, Co may be contained as necessary. However, if Co is contained excessively, producing costs are increased. For this reason, the content of Co is set to 1.00% or less. The content of Co is preferably set to 0.50% or less, more preferably set to 0.30% or less. On the other hand, to provide the effect, the content of Co is preferably set to 0.02% or more.

W: 0 to 1.00%

W (tungsten) has an effect of increasing a creep strength of steel by being dissolved in matrix. For this reason, W may be contained as necessary. However, if W is contained excessively, a stability of austenite phases is degraded, which rather degrades the creep strength and toughness. For this reason, the content of W is set to 1.00% or less. The content of W is preferably set to 0.50% or less, more preferably set to 0.30% or less. On the other hand, to provide the effect, the content of W is preferably set to 0.01% or more.

Ta: 0 to 0.40%

Ta (tantalum) combines with C to produce its carbo-nitrides, thus reducing the dissolved C. As a result, Ta has an effect of increasing the SCC resistance. Ta also has an effect of increasing the creep strength. For this reason, Ta may be contained as necessary. However, if Ta is contained excessively, δ ferrite is produced, which degrades a creep strength, a toughness, and a weldability of the resultant steel. For this reason, the content of Ta is set to 0.40% or less. The content of Ta is preferably set to 0.30% or less, more preferably set to 0.10% or less. On the other hand, to provide the effect, the content of Ta is preferably set to 0.01% or more.

Sn: 0 to 0.0300%

Sn (tin) has an effect of enhancing corrosion resistance and high temperature properties. For this reason, Sn may be contained as necessary. However, if Sn is contained excessively, weldability and producibility are degraded. For this reason, the content of Sn is set to 0.0300% or less. The content of Sn is preferably set to 0.0200% or less, more preferably set to 0.0100% or less. On the other hand, to provide the effect, the content of Sn is preferably set to 0.0010% or more.

Ca: 0 to 0.0100%

Ca (calcium) has an effect of increasing a hot workability and a creep ductility of steel by fixing S and O in the form of their inclusions. For this reason, Ca may be contained as necessary. However, if Ca is contained excessively, the hot workability and the creep ductility are rather degraded. For this reason, the content of Ca is set to 0.0100% or less. The content of Ca is preferably set to 0.0050% or less, more preferably set to 0.0030% or less. On the other hand, to provide the effect, the content of Ca is preferably set to 0.0010% or more.

Mg: 0 to 0.0100%

As with Ca, Mg (magnesium) has an effect of increasing a hot workability and a creep ductility of steel by fixing S and O in the form of their inclusions. For this reason, Mg may be contained as necessary. However, if Mg is contained excessively, the hot workability and long-term creep ductility are rather degraded. For this reason, the content of Mg is set to 0.0100% or less. The content of Mg is preferably set to 0.0050% or less, more preferably set to 0.0030% or less. On the other hand, to provide the effect, the content of Mg is preferably set to 0.0002% or more.

REM: 0 to 0.0800%

As with Ca and Mg, REM (rare earth metal) has an effect of increasing a hot workability and a creep ductility of steel by fixing S and O in the form of their inclusions. For this reason, REM may be contained as necessary. However, if REM is contained excessively, the hot workability and long-term creep ductility are rather degraded. For this reason, the content of REM is set to 0.0800% or less. The content of REM is preferably set to 0.0600% or less, and more preferably set to 0.0400% or less. On the other hand, to provide the effect, the content of REM is preferably set to 0.0010% or more.

Note that REM refers to Sc (scandium), Y (yttrium), and lanthanoids, 17 elements in total, and the content of REM means a total content of these elements. Industrially, REM is often added in the form of misch metal.

In the chemical composition of the austenitic stainless steel in the present embodiment, the balance is Fe and impurities. The "impurities" herein mean components that are mixed in steel from raw materials such as ores and scraps and by various factors in a producing process in the industrial production of the steel and that are allowed to be mixed in the steel within their respective ranges in which the impurities have no adverse effect on the properties of the austenitic stainless steel.

2. Formula (i)

As described above, the dissolved C combines with Cr to form Cr carbides in a use environment that causes exposure to high temperature. As a result, the SCC resistance is degraded. For this reason, it is desirable to reduce an amount of the dissolved C in advance before the austenitic stainless steel is used as a heat-transfer tube for a boiler. Specifically, C should be fixed by V, Ti, and Nb in advance in the form of their precipitates (compounds). Therefore, amounts of V, Ti, and Nb that combine with C to be present in the form of the precipitates, that is, a value of the right side value of Formula (i) is controlled.

$$0.010 \leq V_{ER} + Ti_{ER} + Nb_{ER} \quad \text{(i)}$$

where symbols in the formula are defined as follows.

$V_{ER}$: Content of V in precipitates obtained by extraction residue analysis (mass %)

$Ti_{ER}$: Content of Ti in precipitates obtained by extraction residue analysis (mass %)

$Nb_{ER}$: Content of Nb in precipitates obtained by extraction residue analysis (mass %)

If the right side value of Formula (i) is less than 0.010, the dissolved C is increased, and the dissolved C combines with Cr to form Cr carbides in the use environment. As a result, Cr depleted zone is produced, degrading the SCC resistance. For this reason, the right side value of Formula (i) is set to 0.010 or more. The right side value of Formula (i) is preferably set to 0.012 or more, more preferably set to 0.015 or more, further preferably set to 0.020 or more.

The right side value of Formula (i) is preferably set to 0.120 or less from the viewpoint of weldability. The right side value of Formula (i) is preferably set to 0.100 or less from the viewpoint of a decrease in strength due to excessive fixing of N.

3. Formula (ii)

In the austenitic stainless steel in the present embodiment, solubilities of Ni, Cr, Mo, and Nb in matrix are controlled. This is because keeping the solubilities of the elements enables the enhancement of the creep strength to be achieved while C, which is effective for the creep strength, is reduced. The solubilities in the matrix can be calculated from differences between the contents (mass %) of the elements and contents (mass %) of the elements in the precipitates obtained by the extraction residue analysis. The austenitic stainless steel in the present embodiment needs to satisfy Formula (ii).

$$27.0 \leq 1.13(Ni—Ni_{ER}) + (Cr—Cr_{ER}) + 1.85(Mo—Mo_{ER}) + 1.79(Nb—Nb_{ER}) < 40.5 \quad \text{(ii)}$$

where symbols in the formula are defined as follows, symbols of elements in the formula indicate contents (mass %) of elements contained in the steel, and zero is assigned to a symbol of an element when the element is not contained.

$Nb_{ER}$: Content of Nb in precipitates obtained by extraction residue analysis (mass %)

$Ni_{ER}$: Content of Ni in precipitates obtained by extraction residue analysis (mass %)

$Cr_{ER}$: Content of Cr in precipitates obtained by extraction residue analysis (mass %)

$Mo_{ER}$: Content of Mo in precipitates obtained by extraction residue analysis (mass %)

If the middle value of Formula (ii) is less than 27.0, Ni, Cr, Mo, and Nb are not dissolved sufficiently, failing to enhance the creep strength. For this reason, the middle value of Formula (ii) is set to 27.0 or more. The middle value of Formula (ii) is preferably set to 29.0 or more, more preferably set to 31.0 or more.

On the other hand, if the middle value of Formula (ii) is 40.5 or more, Nb may be excessively dissolved among the elements to combine with the dissolved C, and an amount of Nb to form the precipitates cannot be kept sufficiently, failing to satisfy Formula (i). For this reason, the middle value of Formula (ii) is set to less than 40.5. The middle value of Formula (ii) is preferably set to 39.0 or less, more preferably set to 37.0 or less, further preferably set to 35.0 or less.

4. Formula (iii)

$$Nb_{ER} < 0.052 \quad \text{(iii)}$$

where a symbol in the formula is defined as follows.

$Nb_{ER}$: Content of Nb in precipitates obtained by extraction residue analysis (mass %)

As described above, in the austenitic stainless steel in the present embodiment, C is caused to combine with the elements such as V, Ti, and Nb to precipitate in advance in the form of their precipitates in the pre-use stage. In particular, Nb is preferably caused to precipitate in the form of Nb carbo-nitrides containing Ti. FIG. 1 is a micro-structure photograph obtained by observation of a compound of Nb that was extracted from precipitates obtained by an extraction residue analysis performed on the austenitic stainless steel in the present embodiment. The micro-structure photograph was analyzed, and the compound of Nb was found to be a Nb carbo-nitride containing Ti.

Here, Nb may combine with, for example, N, Cr, and the like in steel to form fine NbCr nitrides. When the fine NbCr nitrides are formed, a value of $Nb_{ER}$ is increased, and the solubility of Cr is decreased. As a result, the austenitic stainless steel becomes unlikely to satisfy Formula (ii). For this reason, Nb is controlled such that Nb does not form the NbCr nitrides but the Nb carbo-nitrides.

In view of the above, the austenitic stainless steel in the present embodiment satisfies Formula (iii). This is because, if the austenitic stainless steel does not satisfy Formula (iii), that is, if $Nb_{ER}$ is 0.052 or more, the NbCr nitrides are formed, and the Nb carbo-nitrides being desired is unlikely to be formed. $Nb_{ER}$ is preferably set to 0.050 or less, more preferably set to 0.045 or less, further preferably set to 0.040 or less, and most preferably set to 0.035 or less.

The contents (mass %) of the elements in the precipitates obtained by the extraction residue analysis described in the items 2 to 4 can be measured by the following procedure. Specifically, about 0.4 g of a sample is electrolyzed with 10%-acetylacetone-1%-tetramethylammonium chloride/methanol at a current value of 20 mA/cm$^2$. A solution of the electrolyzed sample is then passed through a 0.2 μm filter, and then the residue is subjected to acid decomposition. Then, amounts (mass %) of the elements that are analyzed as are calculated with an ICP optical emission spectrometry apparatus.

5. Thickness

A thickness of the austenitic stainless steel in the present embodiment is preferably within the range of 2 to 100 mm with consideration given to its uses. In the case where the austenitic stainless steel has a tubular shape, its wall thickness is preferably within the range of 2 to 95 mm. In the case where the austenitic stainless steel has a shape of a steel sheet or a steel plate, its sheet or plate thickness is preferably within the range of 2 to 35 mm.

6. Production Method

A method for producing the austenitic stainless steel in the present embodiment will be described. As a result of previous research, the present inventors have confirmed that the austenitic stainless steel in the present embodiment can be produced by the following method.

6-1. Melting

A steel having the chemical composition is melted and subjected to continuous casting or the like, by which ingots are produced, and the produced ingots are subjected to blooming, by which billets are produced. Various conditions for producing the billets are to conform to a conventional method.

6-2. Hot Working

Subsequently, the resultant billets are subjected to hot working. Conditions for the hot working are not limited to particular conditions. However, for example, the billets are heated to a temperature within the range of 900 to 1300° C. before the hot working so as not to cause injurious defects in tube-making. There are no particular restrictions provided on a type of the hot working. In the case where a steel sheet or a steel plate is produced, hot rolling can be employed. In the case where a tube is produced, hot extrusion can be employed to form the billets into a tubular shape.

Here, after the hot working is performed, the steel is rapidly cooled under the following conditions.

Time from completion of hot working until start of rapid cooling: 5.0 minutes or less Temperature of steel at start of rapid cooling: 700° C. or more Cooling rate from completion of hot working until start of rapid cooling: 15° C./min or more A time (min) from the completion of the hot working until the start of the rapid cooling will be referred to as a "standing time." In the case where a steel is rapidly cooled after hot working, usually, the steel is rapidly cooled with a water cooling apparatus (water cooling). In other words, the "standing time" refers to a time from the completion of the hot working until the steel is conveyed to the water cooling apparatus, and then the water cooling is started. If the standing time is more than 5 minutes, coarse precipitates are produced. In addition, the NbCr nitrides are likely to be formed rather than the Nb carbo-nitrides being desired.

Further, the precipitates cannot be dissolved in a softening process described later. Thus, precipitates such as nitrides, the Cr carbides, and the NbCr nitrides are coarsely produced, which makes the middle value of Formula (ii) less than the left side value. As a result, the creep strength is decreased. For this reason, the standing time is set to 5.0 minutes or less. The standing time is preferably set to 4.5 minutes or less, more preferably set to 4.0 minutes or less, further preferably set to 3.5 minutes or less.

A temperature (° C.) of the steel at the start of the rapid cooling will be referred to as a "rapid cooling start temperature." If the rapid cooling start temperature is less than 700° C., precipitates such as Cr carbides are coarsely produced. In addition, the NbCr nitrides are likely to be formed rather than the Nb carbo-nitrides being desired. Further, even when the softening treatment is performed, the precipitates cannot be dissolved in matrix, making the middle value of Formula (ii) less than the left side value. As a result, the creep strength is decreased. For this reason, the rapid cooling start temperature is set to 700° C. or more. The rapid cooling start temperature is preferably set to 750° C. or more, more preferably set to 780° C. or more, further preferably set to more than 790° C., and highly preferably set to 800° C. or more.

If the cooling rate (° C./min) from the completion of the hot working until the start of the rapid cooling is less than 15° C./min, precipitates such as nitrides and Cr carbides are coarsely produced. Then, the middle value of Formula (ii) becomes less than the left side value. As a result, the creep strength (or the SCC resistance) is decreased. For this reason, the cooling rate from the completion of the hot working until the start of the rapid cooling is set to 15° C./min or more, preferably set to 18° C./min or more, and more preferably set to 20° C./min or more. Note that the cooling rate is a value that is obtained by dividing a difference between a surface temperature of the steel immediately after the completion of the hot working and a surface temperature of the steel immediately before the start of the rapid cooling by the standing time.

6-3. Softening Treatment

By performing the softening treatment, variations of steel quality in a longitudinal direction and a wall thickness direction that are produced by the hot working are reduced. If the softening treatment is not performed, the coarse precipitates produced by the hot working are not sufficiently dissolved in matrix. Then, in a solution heat treatment described later, a portion where precipitation of Ti, V, and Nb is insufficient develops. As a result, the right side value of Formula (i) may become less than the left side value, degrading the SCC resistance. The softening treatment is thus performed as a step after the hot working so as to homogenize the steel quality. A holding temperature in the softening treatment (hereinafter, will be expressed as a "softening treatment temperature $T_1$") is to be not less than a recrystallization temperature and not more than a grain boundary melting temperature. In the softening treatment, holding should be performed at 1040 to 1300° C.

If the softening treatment temperature $T_1$ is less than 1040° C., Formula (i) is not satisfied, and thus the SCC resistance is degraded. For this reason, the softening treatment temperature $T_1$ is set to 1040° C. or more. The softening treatment temperature $T_1$ is preferably set to 1100° C. or more, more preferably set to 1150° C. or more. On the other hand, if the softening treatment temperature $T_1$ is more than 1300° C., grains become likely to be coarse. For this reason, the softening treatment temperature $T_1$ is set to 1300° C. or less. The softening treatment temperature $T_1$ is preferably set to 1290° C. or less, more preferably set to 1280° C. or less.

A time of the softening treatment is not limited to a particular time. However, the time is desirably 1 to 10 minutes from the viewpoint of recrystallization in a wall thickness direction and production costs.

6-4. First Cooling

After the softening process, the steel is cooled. This cooling is taken as a first cooling. In the first cooling, the steel is cooled at a cooling rate as high as or higher than a cooling rate of water cooling. If the cooling is not performed at the cooling rate as high as or higher than the cooling rate of water cooling, the precipitates are produced and grow, which forms a nonuniform structure. As a result, the nonuniformity may continue in subsequent cold working and solution heat treatment, making product quality inconsistent. For this reason, in the first cooling, the cooling is performed at the cooling rate as high as or higher than the cooling rate of water cooling. This cooling is usually performed until the temperature of the steel reaches 700° C. or less. Note that the cooling rate of the water cooling is usually 2 to 8° C./s.

6-5. Cold Working

After the first cooling, the steel is subjected to cold working. The cold working is working necessary to finish the steel with a dimensional accuracy as specified. As with the hot working, there are no particular restrictions provided on a type of the working. There are no particular specifications on an area reduction ratio of the steel by the working. However, in usual working, the area reduction ratio is about 90% or less.

In the case where a tube is produced, for example, drawing is to be employed as the cold working to form the steel into a predetermined tube shape.

6-6. Solution Heat Treatment

After the cold working, the steel is subjected to the solution heat treatment at 1100 to 1200° C. In the following description, a holding temperature in the solution heat treatment will be expressed as a solution temperature $T_2$. This is because, if the solution temperature $T_2$ is less than 1100° C., the dissolution of the elements effective in the enhancement of the creep strength becomes insufficient, Formula (ii) is not satisfied, and the creep strength is decreased. If the solution temperature $T_2$ is more than 1200° C., the elements intended to precipitate are excessively dissolved, which may cause Formula (i) and/or Formula (ii) not to be satisfied.

The solution temperature $T_2$ is adjusted such that the softening treatment temperature $T_1$ is higher than the solution temperature $T_2$ when the softening treatment temperature $T_1$ and the solution temperature $T_2$ are compared together. That is, the solution temperature $T_2$ is controlled such that Formula (a) shown below is satisfied. This is because, if the solution temperature $T_2$ is higher than the softening treatment temperature $T_1$, it is difficult to be able to sufficiently enhance the SCC resistance.

$$T_1 > T_2 \quad \text{(a)}$$

where symbols in Formula (a) above are defined as follows.

$T_1$: softening treatment temperature $T_2$: solution temperature 6-7. Second Cooling After the solution heat treatment, the steel is cooled. This cooling is taken as a second cooling. In the second cooling, as in the first cooling, the steel is cooled at a cooling rate as high as or higher than a cooling rate of water cooling. This is because, if the cooling is not performed at the cooling rate as high as or higher than the cooling rate of water cooling, the precipitates may be produced and grow to decrease the creep strength, and in addition, product quality may be inconsistent. Usually, this cooling is preferably performed until the temperature of the steel reaches 600° C. or less.

The present embodiment will be described below more specifically with Examples, but the present embodiment is not limited to these Examples.

EXAMPLE

Steels having chemical compositions shown in Table 1 were melted and subjected to blooming into hollow billets. The billets were subjected to the hot working into a tubular shape of a size (outer diameter: 56 mm×wall thickness: 10.5 mm×length: 6684 mm) and rapidly cooled under conditions shown in Table 2. The steels were then subjected to the softening treatment in which the steels were subjected to the holding for 3 minutes under conditions shown in Table 2, then water cooled, and subjected to the cold working at an area reduction ratio of 35.7%. That is, the cold working was performed in such a manner as to make the steel have a wall thickness of 8.35 mm. All softening treatment temperatures $T_1$ were not less than the recrystallization temperature and not more than the grain boundary melting temperature. Subsequently, the steels were subjected to the solution heat treatment in which the steels were holding for two minutes under conditions shown in Table 2, and then water cooled. tubes were thereby obtained.

TABLE 1

| Steel No. | Chemical composition (mass %, Balance: Fe and Impurities) C | Si | Mn | P | S | Cu | Ni | Cr | Mo | Nb | N |
|---|---|---|---|---|---|---|---|---|---|---|---|
| 1 | 0.009 | 0.19 | 0.9 | 0.006 | 0.001 | 3.01 | 11.51 | 18.53 | 0.79 | 0.42 | 0.11 |
| 2 | 0.009 | 0.22 | 0.8 | 0.022 | 0.001 | 2.99 | 9.84 | 18.42 | 0.20 | 0.47 | 0.11 |
| 3 | 0.009 | 0.10 | 0.7 | 0.022 | 0.005 | 2.98 | 9.08 | 18.35 | 0.80 | 0.60 | 0.10 |
| 4 | 0.008 | 0.22 | 0.8 | 0.032 | 0.010 | 2.98 | 9.79 | 18.46 | 0.25 | 0.48 | 0.10 |
| 5 | 0.009 | 0.22 | 0.7 | 0.031 | 0.006 | 2.50 | 9.00 | 18.38 | 0.32 | 0.47 | 0.14 |
| 6 | 0.002 | 0.60 | 0.7 | 0.032 | 0.004 | 2.98 | 9.71 | 18.29 | 0.34 | 0.15 | 0.13 |
| 7 | 0.009 | 0.28 | 1.0 | 0.030 | 0.002 | 3.00 | 9.87 | 15.02 | 0.29 | 0.49 | 0.09 |
| 8 | 0.009 | 0.22 | 0.8 | 0.031 | 0.009 | 4.50 | 10.76 | 18.39 | 0.26 | 0.47 | 0.10 |
| 9 | 0.008 | 0.23 | 0.8 | 0.031 | 0.001 | 2.99 | 9.77 | 18.33 | 0.28 | 0.42 | 0.11 |
| 10 | 0.015 | 0.22 | 0.8 | 0.022 | 0.005 | 2.98 | 10.79 | 18.36 | 0.32 | 0.28 | 0.10 |
| 11 | 0.008 | 0.25 | 0.8 | 0.030 | 0.001 | 2.92 | 9.72 | 18.24 | 0.27 | 0.46 | 0.10 |
| 12 | 0.008 | 0.23 | 0.8 | 0.031 | 0.001 | 2.98 | 10.81 | 20.00 | 0.22 | 0.49 | 0.11 |
| 13 | 0.009 | 0.19 | 0.8 | 0.034 | 0.001 | 3.97 | 14.73 | 18.23 | 0.29 | 0.56 | 0.10 |
| 14 | 0.009 | 0.23 | 2.0 | 0.035 | 0.008 | 2.97 | 15.07 | 18.29 | 0.31 | 0.44 | 0.11 |
| 15 | 0.009 | 0.23 | 0.8 | 0.030 | 0.001 | 2.98 | 10.78 | 18.46 | 0.25 | 0.49 | 0.11 |
| 16 | 0.008 | 0.21 | 0.8 | 0.027 | 0.001 | 3.00 | 10.99 | 18.63 | 0.70 | 0.50 | 0.10 |
| 17 | 0.011 | 0.21 | 0.8 | 0.025 | 0.001 | 2.99 | 9.06 | 15.11 | 0.23 | 0.17 | 0.07 |
| 18 | 0.008 | 0.19 | 1.5 | 0.032 | 0.001 | 2.99 | 15.97 | 19.95 | 1.49 | 0.52 | 0.05 |
| 19 | 0.009 | 0.22 | 0.7 | 0.031 | 0.006 | 2.50 | 14.85 | 18.38 | 0.32 | 0.47 | 0.14 |
| 20 | 0.010 | 0.22 | 0.2 | 0.035 | 0.001 | 3.02 | 14.98 | 18.51 | 0.28 | 0.51 | 0.10 |
| 21 | 0.090 | 0.21 | 0.8 | 0.032 | 0.001 | 3.05 | 10.08 | 18.80 | 0.45 | 0.45 | 0.11 |

| Steel No. | Chemical composition (mass %, Balance: Fe and Impurities) B | V | Ti | Co | W | Ta | Sn | Ca | Mg | REM |
|---|---|---|---|---|---|---|---|---|---|---|
| 1 | 0.0028 | — | — | — | — | — | — | — | — | — |
| 2 | 0.0041 | — | — | — | — | — | — | — | — | — |
| 3 | 0.0042 | — | — | — | — | — | — | — | — | — |
| 4 | 0.0042 | — | — | — | — | — | — | — | — | — |
| 5 | 0.0041 | — | — | — | — | — | — | — | — | — |
| 6 | 0.0010 | — | — | — | — | — | — | — | — | — |
| 7 | 0.0038 | — | — | — | — | — | — | — | — | — |
| 8 | 0.0041 | — | — | — | — | — | — | — | — | — |
| 9 | 0.0060 | 0.05 | 0.500 | — | — | | — | — | — | — |
| 10 | 0.0044 | 0.20 | 0.302 | — | — | 0.04 | — | — | — | — |
| 11 | 0.0039 | 0.05 | 0.466 | 0.05 | — | — | — | — | 0.0005 | — |
| 12 | 0.0041 | 0.05 | 0.204 | — | 0.02 | — | — | — | — | — |
| 13 | 0.0043 | 0.33 | 0.252 | — | — | — | 0.0098 | 0.0014 | — | — |
| 14 | 0.0040 | 0.01 | 0.500 | 0.30 | — | — | 0.0130 | — | — | — |
| 15 | 0.0042 | 0.03 | 0.001 | 0.05 | — | 0.01 | | — | — | — |
| 16 | 0.0043 | 0.50 | — | 0.13 | — | — | 0.0030 | — | — | — |
| 17 | 0.0040 | — | — | — | — | — | — | — | — | — |
| 18 | 0.0043 | — | — | — | — | — | — | — | — | — |
| 19 | 0.0041 | — | — | — | — | — | — | — | — | — |
| 20 | 0.0040 | 0.30 | 0.050 | — | — | — | — | — | — | 0.0034 |
| 21 | 0.0033 | — | — | — | — | — | — | — | — | — |

The mark "*" indicates that the value with the mark fell out of the range defined in the present invention.

TABLE 2

| Test No. | Steel No. | Producing condition: Rapid cooling after hot working: Standing time (min) | Rapid cooling start temperature (° C.) | Cooling rate from completion of hot working until start of rapid cooling (° C./min) | Softening treatment Temperature $T_1$ (° C.) | Solution heat treatment Temperature $T_2$ (° C.) |
|---|---|---|---|---|---|---|
| 1 | 1 | 1.0 | 900 | 50 | 1250 | 1150 |
| 2 | 2 | 3.0 | 900 | 50 | 1250 | 1170 |
| 3 | 3 | 1.0 | 900 | 50 | 1200 | 1170 |
| 4 | 4 | 1.0 | 900 | 50 | 1200 | 1170 |
| 5 | 5 | 1.0 | 900 | 50 | 1275 | 1190 |
| 6 | 6 | 1.0 | 900 | 50 | 1250 | 1200 |
| 7 | 7 | 1.0 | 900 | 50 | 1200 | 1170 |
| 8 | 8 | 1.0 | 700 | 50 | 1250 | 1170 |
| 9 | 9 | 1.0 | 900 | 20 | 1250 | 1170 |
| 10 | 10 | 5.0 | 900 | 50 | 1250 | 1170 |
| 11 | 11 | 1.0 | 900 | 50 | 1200 | 1170 |
| 12 | 12 | 1.0 | 900 | 15 | 1200 | 1100 |

TABLE 2-continued

| | | Producing condition | | | | |
|---|---|---|---|---|---|---|
| | | Rapid cooling after hot working | | | | |
| Test No. | Steel No. | Standing time (min) | Rapid cooling start temperature (° C.) | Cooling rate from completion of hot working until start of rapid cooling (° C./min) | Softening treatment Temperature $T_1$ (° C.) | Solution heat treatment Temperature $T_2$ (° C.) |
| 13 | 13 | 1.0 | 900 | 15 | 1250 | 1170 |
| 14 | 14 | 1.0 | 900 | 50 | 1250 | 1150 |
| 15 | 15 | 1.0 | 900 | 50 | 1250 | 1170 |
| 16 | 16 | 1.0 | 900 | 50 | 1250 | 1170 |
| 17 | 20 | 1.0 | 900 | 50 | 1280 | 1150 |
| 18 | 17 | 1.0 | 900 | 50 | 1250 | 1250 |
| 19 | 18 | 1.0 | 900 | 50 | 1100 | 1250 |
| 20 | 19 | 1.0 | 900 | 50 | 1200 | 1250 |
| 21 | 21* | 1.0 | 900 | 50 | 1200 | 1200 |
| 22 | 7 | 1.0 | 900 | 50 | Not performed | 1200 |
| 23 | 7 | 1.0 | 900 | 50 | 1250 | 1050 |
| 24 | 7 | 1.0 | 900 | 50 | 1250 | 1250 |
| 25 | 7 | 8.0 | 750 | 20 | 1250 | 1170 |
| 26 | 7 | 1.0 | 600 | 50 | 1250 | 1170 |
| 27 | 7 | 1.0 | 900 | 10 | 1250 | 1170 |
| 28 | 7 | 1.0 | 900 | 50 | 1150 | 1200 |
| 29 | 7 | 1.0 | 900 | 50 | 1030 | 1190 |

The mark "*" indicates that the value with the mark fell out of the range defined in the present invention.

The underlines each indicate that the value fell out of the preferable producing condition in the present embodiment (excluding the double-underlined example described below).

The double underlines indicate that the values fell out of the preferable producing condition in the present embodiment because the values did not satisfy the condition T1 > T2 while satisfying the preferable temperature ranges for the respective heat treatments.

The resultant tubes were subjected to measurement of extraction residues, an SCC test, and a creep test by procedures described below.

(Extraction Residues)

Contents (mass %) of elements: V, Ti, Nb, Ni, Cr, and Mo in precipitates obtained by an extraction residue analysis were calculated by the following procedure, and the right side value of Formula (i), the middle value of Formula (ii), and the left side value of Formula (iii) were calculated.

Specifically, about 0.4 g of a sample was electrolyzed with 10%-acetylacetone-1%-tetramethylammonium chloride/methanol at a current value of 20 mA/cm$^2$. A solution of the electrolyzed sample was then passed through a 0.2 μm filter, and then the residue was subjected to acid decomposition with a mixed acid of sulfuric acid+phosphoric acid+nitric acid+perchloric acid. Amounts (mass %) of the elements that were analyzed as extraction residues were then calculated with an ICP optical emission spectrometry apparatus.

(SCC Test)

The SCC resistance was evaluated by conducting an SCC test in conformance with ASTM A262 Method E. Specifically, a specimen measuring 15 mm×2 mm×70 mm was extracted from one end of each of the resultant austenitic stainless steels. The specimen was subjected to a sensitization heat treatment of 700° C.×30 minutes, was then immersed for 24 h in a boiled solution of sulfuric acid/copper sulfate solution, as specified in the standard, to which about 70 g of machined copper chip was added and was subjected to a bending test.

(Creep Test)

To evaluate the creep strength, a creep test was conducted. Specifically, round-bar creep test specimens were extracted and subjected to a creep rupture test. The evaluation was conducted such that a specimen was evaluated as "excellent" when the specimen showed a rupture strength of 210 MPa or more in the creep test conducted at 600° C. for 10000 h and showed a rupture strength of 150 MPa or more in the creep test conducted at 650° C. for 10000 h.

A specimen other than the specimens evaluated as "excellent" was evaluated as "good" when the specimen satisfied only one of a rupture strength of 210 MPa or more in the creep test conducted at 600° C. for 10000 h and a rupture strength of 150 MPa or more in the creep test conducted at 650° C. for 10000 h. In addition, an example other than the examples evaluated as "excellent" or "good" were expressed as "Bad" when its creep properties were Bad. Results are collectively shown in Table 3 below.

TABLE 3

| | | Amounts of residue of elements (%) | | | | | | | | Properties | | |
|---|---|---|---|---|---|---|---|---|---|---|---|---|
| Test No. | Steel No. | $V_{ER}$ | $Ti_{ER}$ | $Nb_{ER}$ Left side value of Formula (iii) | $Ni_{ER}$ | $Cr_{ER}$ | $Mo_{ER}$ | Right side value of Formula (i) (%) | Middle value of Formula (ii) (%) | SCC test | Creep properties | |
| 1 | 1 | — | — | 0.031 | 0.011 | 0.238 | 0.0020 | 0.031 | 33.4 | No cracking | Excellent | Inventive example |
| 2 | 2 | — | — | 0.027 | 0.001 | 0.018 | 0.0002 | 0.027 | 30.7 | No cracking | Good | |
| 3 | 3 | — | — | 0.023 | 0.000 | 0.017 | 0.0020 | 0.023 | 31.1 | No cracking | Excellent | |
| 4 | 4 | — | — | 0.022 | 0.001 | 0.018 | 0.0003 | 0.022 | 30.8 | No cracking | Good | |

TABLE 3-continued

| Test No. | Steel No. | Amounts of residue of elements (%) $V_{ER}$ | $Ti_{ER}$ | $Nb_{ER}$ Left side value of Formula (iii) | $Ni_{ER}$ | $Cr_{ER}$ | $Mo_{ER}$ | Right side value of Formula (i) (%) | Middle value of Formula (ii) (%) | Properties SCC test | Creep properties | |
|---|---|---|---|---|---|---|---|---|---|---|---|---|
| 5 | 5 | — | — | 0.011 | 0.000 | 0.006 | 0.0004 | 0.011 | 30.0 | No cracking | Good | |
| 6 | 6 | — | — | 0.010 | 0.001 | 0.005 | 0.0004 | 0.010 | 30.1 | No cracking | Good | |
| 7 | 7 | — | — | 0.025 | 0.001 | 0.003 | 0.0005 | 0.025 | 27.5 | No cracking | Good | |
| 8 | 8 | — | — | 0.023 | 0.002 | 0.018 | 0.0003 | 0.023 | 31.8 | No cracking | Excellent | |
| 9 | 9 | 0.001 | 0.020 | 0.027 | 0.001 | 0.017 | 0.0003 | 0.048 | 30.6 | No cracking | Good | |
| 10 | 10 | 0.006 | 0.013 | 0.012 | 0.002 | 0.017 | 0.0004 | 0.031 | 31.6 | No cracking | Excellent | |
| 11 | 11 | 0.002 | 0.019 | 0.022 | 0.001 | 0.017 | 0.0003 | 0.043 | 30.5 | No cracking | Good | |
| 12 | 12 | 0.008 | 0.034 | 0.047 | 0.002 | 0.023 | 0.0002 | 0.089 | 33.4 | No cracking | Excellent | |
| 13 | 13 | 0.010 | 0.011 | 0.023 | 0.005 | 0.017 | 0.0004 | 0.044 | 36.3 | No cracking | Excellent | |
| 14 | 14 | 0.001 | 0.020 | 0.027 | 0.005 | 0.017 | 0.0004 | 0.048 | 36.6 | No cracking | Excellent | |
| 15 | 15 | 0.001 | 0.001 | 0.027 | 0.002 | 0.018 | 0.0003 | 0.029 | 31.9 | No cracking | Excellent | |
| 16 | 16 | 0.012 | — | 0.022 | 0.002 | 0.018 | 0.0020 | 0.034 | 33.2 | No cracking | Excellent | |
| 17 | 20 | 0.018 | 0.008 | 0.037 | 0.007 | 0.020 | 0.0008 | 0.063 | 36.8 | No cracking | Excellent | |
| 18 | 17 | — | — | 0.015 | 0.000 | 0.006 | 0.0003 | 0.015 | 26.0 * | No cracking | Bad | Comparative |
| 19 | 18 | — | — | 0.008 | 0.000 | 0.007 | 0.0000 | 0.008 * | 41.7 * | Cracked | Excellent | example |
| 20 | 19 | — | — | 0.006 | 0.000 | 0.004 | 0.0000 | 0.006 * | 36.6 | Cracked | Excellent | |
| 21 | 21 * | — | — | 0.007 | 0.000 | 0.005 | 0.0000 | 0.007 * | 31.8 | Cracked | Excellent | |
| 22 | 7 | — | — | 0.009 | 0.002 | 0.015 | 0.0011 | 0.009 * | 27.6 | Cracked | Good | |
| 23 | 7 | — | — | 0.268 * | 0.009 | 0.145 | 0.0099 | 0.268 | 26.9 * | No cracking | Bad | |
| 24 | 7 | — | — | 0.005 | 0.001 | 0.003 | 0.0009 | 0.005 * | 27.6 | Cracked | Good | |
| 25 | 7 | — | — | 0.123 * | 0.290 | 0.305 | 0.0044 | 0.123 | 26.7 * | No cracking | Bad | |
| 26 | 7 | — | — | 0.112 * | 0.222 | 0.216 | 0.0040 | 0.112 | 26.9 * | No cracking | Bad | |
| 27 | 7 | — | — | 0.050 | 0.189 | 0.286 | 0.0293 | 0.050 | 26.9 * | No cracking | Bad | |
| 28 | 7 | — | — | 0.009 | 0.000 | 0.010 | 0.0002 | 0.009 * | 27.6 | Cracked | Good | |
| 29 | 7 | — | — | 0.009 | 0.002 | 0.012 | 0.0005 | 0.009 * | 27.6 | Cracked | Good | |

The mark "*" indicates that the value with the mark fell out of the range defined in the present embodiment.

$0.010 \leq V_{ER} + Ti_{ER} + Nb_{ER}$ . . . (i)

$27.0 \leq 1.13(Ni—Ni_{ER}) + (Cr—Cr_{ER}) + 1.85(Mo—Mo_{ER}) + 1.79(Nb—Nb_{ER}) < 40.5$ . . . (ii)

$Nb_{ER} < 0.052$ . . . (iii)

In Test Nos. 1 to 17, which satisfied the requirements according to the present invention, their SCC resistances and creep strengths were satisfactory. In contrast, in Test Nos. 18 to 29, which did not satisfy the requirements according to the present invention, the results were that either or both their creep strengths and SCC resistances were poor.

In Test Nos. 1 to 18, 23, and 25 to 27, no cracking occurred in the SCC resistance test. These examples satisfied Formula (i). It is thus considered that C was immobilized by the precipitation of V, Ti, and Nb even after the sensitization heat treatment, suppressing the formation of intergranular Cr carbides, thus preventing cracking.

In contrast, in Test Nos. 19 to 22, 24, 28, and 29, cracking occurred in the SCC resistance test. These examples did not satisfy Formula (i). It is thus considered that the precipitation of V, Ti, and Nb was insufficient, which causes formation of Cr carbides in grain boundaries after the sensitization heat treatment, producing Cr depleted zone on the peripheries of the Cr carbides, thus causing the occurrence of the cracking in the SCC resistance test. A possible reason for this is that their chemical compositions, their softening treatment temperatures, or their solution temperatures fell out of the respective preferable ranges.

Test Nos. 1, 3, 8, 10, 12 to 17, and 19 to 21 were evaluated as "excellent" in the creep test. It is considered that middle values of Formula (ii) of these examples, which were not less than the more preferable lower limit value of the middle value, made these examples excellent in the creep strength. In Test Nos. 2, 4 to 7, 9, 11, 22, 24, 28, and 29 were evaluated as "good" in the creep test. These examples satisfied Formula (ii) while their middle values of Formula (ii) were less than the more preferable lower limit value. It is thus considered that the elements contributing to the creep strength were sufficiently dissolved, which provided favorable creep strengths suitable for the present invention.

In contrast, Test Nos. 18, 23, and 25 to 27 were evaluated as "Bad" in the creep test. In these examples, their middle values of Formula (ii) were less than 27.0. It is thus considered that the dissolution of Ni, Cr, Mo, and Nb enhancing the creep strength was insufficient, which thus failed to provide a sufficient creep strength. Among them. Nos. 23, 25, and 26 did not satisfy Formula (iii). It is thus considered that the NbCr nitrides were formed, decreasing the creep strength.

The invention claimed is:

1. An austenitic stainless steel having a chemical composition comprising, in mass %:

C: 0.002 to 0.020%,
Si: 0.10 to 0.60%,
Mn: 0.2 to 2.0%,
P: 0.035% or less,
S: 0.010% or less,
Cu: 2.50 to 4.50%,
Ni: 9.00 to 16.00%,
Cr: 15.00 to 20.00%,
Mo: 0.20 to 1.50%,
Nb: 0.15 to 0.60%,
N: 0.05 to 0.15%,
B: 0.0010 to 0.0060%,
V: 0 to 0.50%,
Ti: 0 to 0.500%,
Co: 0 to 1.00%,
W: 0 to 1.00%,
Ta: 0 to 0.40%, Sn: 0 to 0.0300%,
Ca: 0 to 0.0100%,
Mg: 0 to 0.0100%, and
REM: 0 to 0.0800%,
with the balance: Fe and impurities, and
satisfies Formulas (i) to (iii) shown below:

$$0.010 \leq V_{ER} + Ti_{ER} + Nb_{ER} \quad \text{(i)}$$

$$27.0 \leq 1.13(Ni—Ni_{ER}) + (Cr—Cr_{ER}) + 1.85(Mo—Mo_{ER}) + 1.79(Nb—Nb_{ER}) < 40.5 \quad \text{(ii)}$$

$$Nb_{ER} < 0.052 \quad \text{(iii)}$$

where symbols in the formulas are defined as follows, symbols of elements indicate contents (mass %) of the elements contained in the steel, and zero is assigned to a symbol of an element when the element is not contained:

$V_{ER}$: Content of V in precipitates obtained by extraction residue analysis (mass %)

$Ti_{ER}$: Content of Ti in precipitates obtained by extraction residue analysis (mass %)

$Nb_{ER}$: Content of Nb in precipitates obtained by extraction residue analysis (mass %)

$Ni_{ER}$: Content of Ni in precipitates obtained by extraction residue analysis (mass %)

$Cr_{ER}$: Content of Cr in precipitates obtained by extraction residue analysis (mass %)

$Mo_{ER}$: Content of Mo in precipitates obtained by extraction residue analysis (mass %).

2. The austenitic stainless steel according to claim 1, wherein the chemical composition contains, in mass %, one or more of:
V: 0.01 to 0.50%, and
Ti: 0.001 to 0.500%.

3. The austenitic stainless steel according to claim 1, wherein the chemical composition contains, in mass %, one or more of:
Co: 0.02 to 1.00%,
W: 0.01 to 1.00%,
Ta: 0.01 to 0.40%,
Sn: 0.0010 to 0.0300%,
Ca: 0.0010 to 0.0100%,
Mg: 0.0002 to 0.0100%, and
REM: 0.0010 to 0.0800%.

4. The austenitic stainless steel according to claim 2, wherein the chemical composition contains, in mass %, one or more of:
Co: 0.02 to 1.00%,
W: 0.01 to 1.00%,
Ta: 0.01 to 0.40%,
Sn: 0.0010 to 0.0300%,
Ca: 0.0010 to 0.0100%,
Mg: 0.0002 to 0.0100%, and
REM: 0.0010 to 0.0800%.

5. A tube comprising the austenitic stainless steel according to claim 1.

6. A tube comprising the austenitic stainless steel according to claim 2.

7. A tube comprising the austenitic stainless steel according to claim 3.

8. A tube comprising the austenitic stainless steel according to claim 4.

* * * * *